US010905232B2

(12) United States Patent
Verhappen

(10) Patent No.: US 10,905,232 B2
(45) Date of Patent: Feb. 2, 2021

(54) HEIGHT ADJUSTABLE DESK OR TABLE

(71) Applicant: Koninklijke Ahrend B.V., Amsterdam (NL)

(72) Inventor: Henricus Reinier Martina Verhappen, Amsterdam (NL)

(73) Assignee: KONINKLIJKE AHREND B.V., Amsterdam (NL)

( * ) Notice: Subject to any disclaimer, the term of this patent is extended or adjusted under 35 U.S.C. 154(b) by 0 days.

(21) Appl. No.: 16/578,918

(22) Filed: Sep. 23, 2019

(65) Prior Publication Data

US 2020/0093259 A1 Mar. 26, 2020

(30) Foreign Application Priority Data

Sep. 24, 2018 (NL) ..... 2021684

(51) Int. Cl.
*A47B 9/10* (2006.01)
*A47B 9/14* (2006.01)
*A47B 21/02* (2006.01)

(52) U.S. Cl.
CPC ..... *A47B 9/10* (2013.01); *A47B 9/14* (2013.01); *A47B 21/02* (2013.01)

(58) Field of Classification Search
CPC .... A47B 9/16; A47B 9/10; A47B 9/12; A47B 9/14; A47B 9/20; A47B 2200/0061; A47B 2200/005; A47B 21/02; A47B 13/02; A47B 9/00; A47B 2200/0051; A47C 20/08
See application file for complete search history.

(56) References Cited

U.S. PATENT DOCUMENTS 4,619,208 A * 10/1986 Kurrasch ..... A47B 9/12 108/106
4,647,026 A * 3/1987 Siemann ..... F16F 9/516 188/281
5,797,331 A * 8/1998 Watt ..... A47B 9/02 108/146

(Continued)

FOREIGN PATENT DOCUMENTS

AU 200179360 4/2002
DE 29624377 11/2002

(Continued)

*Primary Examiner* — Hanh V Tran
(74) *Attorney, Agent, or Firm* — Peacock Law P.C.; Justin Muehlmeyer

(57) ABSTRACT

A height adjustable desk or table comprising a desk or table top, and a frame with spaced apart legs for supporting the desk or table top, wherein each of the legs comprises a movable upper portion and a lower stationary portion, and wherein a first cable is guided via first guide means connected with a lower end of the movable upper portion of the first leg via second guide means to a lower end of the lower stationary portion of the second leg, and a second cable is guided via third guide means connected with a lower end of the movable upper portion of the second leg via fourth guide means to a lower end of the lower stationary portion of the first leg, wherein each of the legs comprises a gas spring, and wherein for each gas spring the upper portion of the gas spring is arranged to be up-and-down movable portion of the leg and the lower portion of each gas spring is arranged to be the lower stationary portion of the leg.

4 Claims, 10 Drawing Sheets

(56) References Cited

U.S. PATENT DOCUMENTS

| | | | | |
|---|---|---|---|---|
| 5,941,182 | A * | 8/1999 | Greene | A47B 9/12 108/147 |
| 6,062,148 | A * | 5/2000 | Hodge | A47B 9/02 108/147 |
| 6,152,049 | A * | 11/2000 | Schmidt | A47B 9/12 108/147 |
| 6,299,113 | B1 * | 10/2001 | Yamashita | A47B 9/20 248/161 |
| 9,038,549 | B1 * | 5/2015 | Zebarjad | A47B 9/02 108/147 |
| 2001/0037751 | A1 * | 11/2001 | Agee | A47B 9/12 108/147 |
| 2002/0050112 | A1 * | 5/2002 | Koch | A47B 9/20 52/651.07 |
| 2006/0130713 | A1 * | 6/2006 | Jones | A47B 9/00 108/106 |
| 2009/0072101 | A1 * | 3/2009 | Stoelinga | A47B 9/12 248/188.5 |
| 2009/0320206 | A1 * | 12/2009 | Dyreby | A47B 9/20 5/611 |
| 2010/0187380 | A1 * | 7/2010 | Koder | A47B 9/04 248/188.5 |
| 2012/0227642 | A1 * | 9/2012 | Sekikawa | A47B 9/10 108/147 |
| 2015/0047538 | A1 * | 2/2015 | Ergun | A47B 9/02 108/147 |
| 2015/0320198 | A1 * | 11/2015 | Zebarjad | A47B 9/00 108/147 |
| 2016/0037907 | A1 * | 2/2016 | Ergun | A47B 9/12 108/147 |
| 2016/0061241 | A1 * | 3/2016 | Hansen | A47B 9/06 108/147.21 |
| 2016/0095426 | A1 * | 4/2016 | Tempas | A47B 9/20 108/147 |
| 2016/0227921 | A1 * | 8/2016 | Hansen | A47B 9/02 |
| 2016/0296005 | A1 * | 10/2016 | Stoelinga | A47B 9/12 |
| 2018/0064241 | A1 * | 3/2018 | Tseng | A47B 9/10 |
| 2018/0092457 | A1 * | 4/2018 | Lai | A47B 9/10 |
| 2018/0355937 | A1 * | 12/2018 | Tao | F16F 9/063 |
| 2018/0355938 | A1 * | 12/2018 | Tao | F16F 9/062 |

FOREIGN PATENT DOCUMENTS

| | | | | |
|---|---|---|---|---|
| EP | 1987734 | A1 * | 11/2008 | A47B 9/12 |
| EP | 2499934 | | 9/2012 | |

* cited by examiner

HEIGHT ADJUSTABLE DESK OR TABLE

CROSS-REFERENCE TO RELATED APPLICATIONS

This application claims priority to Netherlands Patent Application No. 2021684, entitled "A Height Adjustable Desk or Table", filed on Sep. 24, 2018, and the specification and claims thereof are incorporated herein by reference.

BACKGROUND OF THE INVENTION

Embodiments of the present invention relates to a height adjustable desk or table comprising a desk or table top, and a frame with spaced apart legs for supporting the desk or table top, wherein each of the legs comprises a movable upper portion and a lower stationary portion, and wherein a first cable is guided via first guide means connected with a lower end of the movable upper portion of the first leg via second guide means to a lower end of the lower stationary portion of the second leg, and a second cable is guided via third guide means connected with a lower end of the movable upper portion of the second leg via fourth guide means to a lower end of the lower stationary portion of the first leg.

A height adjustable desk or tabletop is known from AU20179360 A1.

BRIEF SUMMARY OF THE INVENTION

It is an object of one or more embodiments of the present invention to improve the known adjustable desk or tabletop and convert it into practical application.

A height adjustable desk or tabletop according to one or more embodiments of the present invention has the features of one or more of the appended claims.

In an embodiment of the present invention, each of the legs preferably comprises a gas spring, wherein for each gas spring the upper portion of the gas spring is arranged to be up-and-down movable portion of the leg and the lower portion of each gas spring is arranged to be the lower stationary portion of the leg. This has numerous advantages, one of which is that a spindle that is used in a conventional height adjustable desk or table is no longer required. Another advantage is that the invention provides a low-cost height adjustable desk or table, because it also avoids the use of a motor drive which is applied in more costly motor driven height adjustable desks or tables. The height adjustment with the desktop of the invention can be executed quickly and in an intuitive manner without use of any electrical energy for a motor drive. All in all, the height adjustable desk or table of the invention addresses the need of market segments in which such height adjustability is required, but the funds are limited. Still another advantage is that by avoiding a motor drive, the desk or table of the invention can be applied anywhere, thus increasing the versatility in places where the desk or table of the invention can be applied. There is no need for the presence of a wall socket for an electrical appliance.

It is remarked that AU20179360 A1 suggests the use of a force reservoir embodied as a pneumatic spring in one of the legs of the table, but the publication is entirely silent on how this should be implemented and it provides therefore no workable solution, let alone a disclosure that can be deemed sufficient to enable a skilled person to work according to the proposed solution. With the instant invention an enabling disclosure is provided in the aspect that each of the legs comprises a gas spring, wherein for each gas spring the upper portion of the gas spring is arranged to be up-and-down movable portion of the leg and the lower portion of each gas spring is arranged to be the lower stationary portion of the leg.

A further preferable feature is that one or both of the gas springs is provided with a valve to enable regulation of the pressure in the gas springs. This provides the opportunity for the customer himself to compensate for heavy weights that may be positioned on the table or desk.

In one embodiment according to the invention the cables are preferably provided with a horizontal part extending between the spaced apart legs, wherein said horizontal part comprises a section with a corrugated surface or screw thread, which section cooperates with an arresting block which is manipulable with a handle and which arresting block is capable to fix said section in a selected position so as to fix the height of the desk or table top. This makes height adjustment of the desk or table very easy, and also provides a reliable means of fixing the desk or table at a desired height.

In another more preferred embodiment, at least one of the legs is preferably provided with a rail with slots, wherein the slots are equipped to receive an arresting pin to selectively block movement of the movable upper portion with respect to the lower portion of such leg. This can effectively arrest the desk or table top at a required height, which may be done particularly easy by arranging that the arresting pin is provided at a stationary position of the lower portion of the leg, and has actuating means that are provided at a side of the desk or table top.

Another preferable feature is that the desk or table is assembled from modular parts together forming the desk or tabletop and the frame with spaced apart legs as well as the gas springs. This also applies to the dual cable linkage which at least comprises two separate cables, the first cable that connects an upper portion of a first leg to a lower portion of a second leg and a second cable that connects an upper portion of the second leg to a lower portion of the first leg. This means not only that this dual cable linkage can be placed on the markets as an additional unit for an existing desk or table, but also that the desk or table of the invention can be assembled by a customer in the privacy of its own home.

The modularity of the desk or table of the invention also means that legs can be applied with desktops or tabletops with different dimensions.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more embodiments of the invention and are not to be construed as limiting the invention. In the drawing:

FIG. 4B-4C show detail aspects of a preferred arresting system of the desk or tabletop according to an embodiment of the present invention;

FIGS. 5 and 6 each show separately a single cable that connects to different parts of the left and right leg of the desk or table, when the tabletop is at a high position, according to an embodiment of the present invention;

DETAILED DESCRIPTION OF THE INVENTION

Figure 1A:
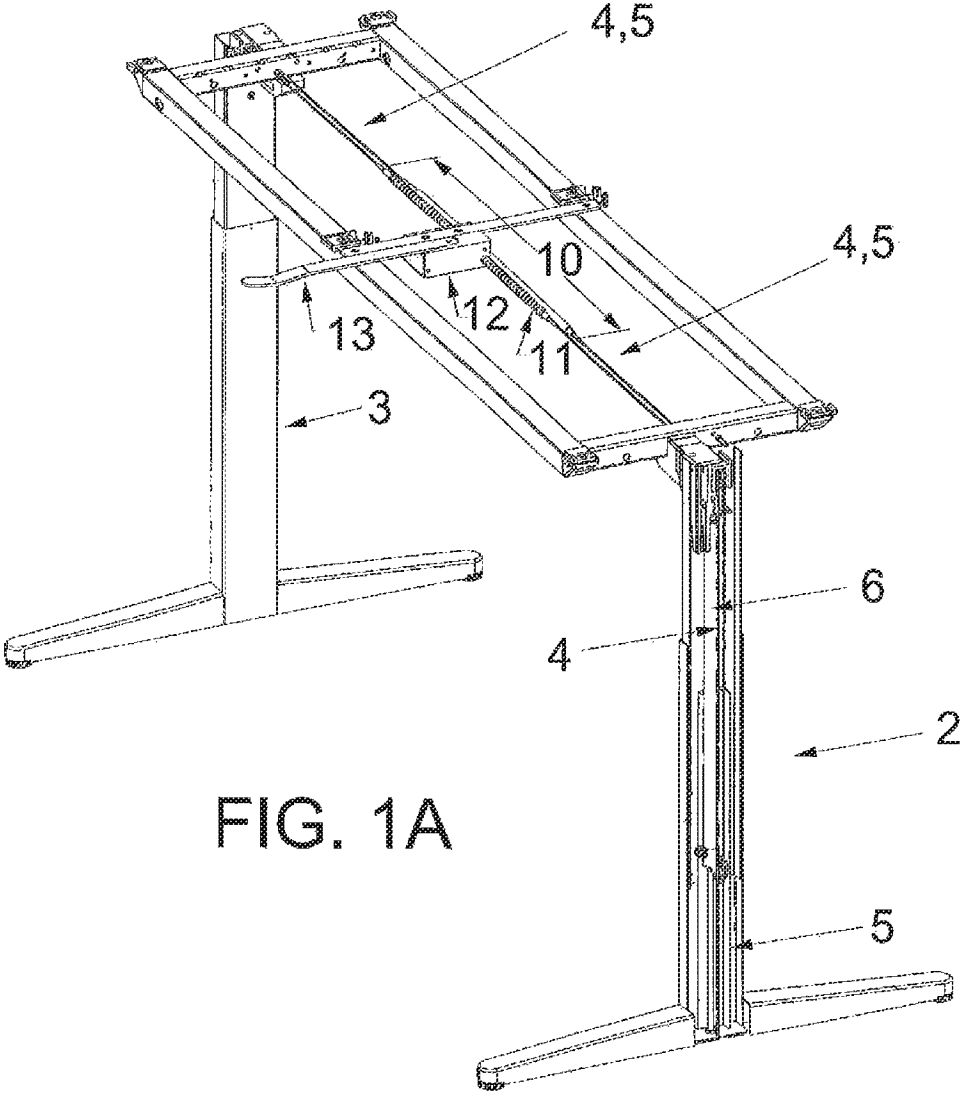
FIG. 1A shows in a perspective view a frame of a first embodiment of a desk or table according to an embodiment of the present invention.

Whenever in the figures the same reference numerals are applied, these numerals refer to the same parts.

In FIG. 1A a perspective view of a frame 1 of a height adjustable desk or table comprising a desk or tabletop is shown. For clarity the desk or tabletop mounted on top of the frame is not shown, but only the frame 1 itself that supports the desk or tabletop.

Figure 1B:
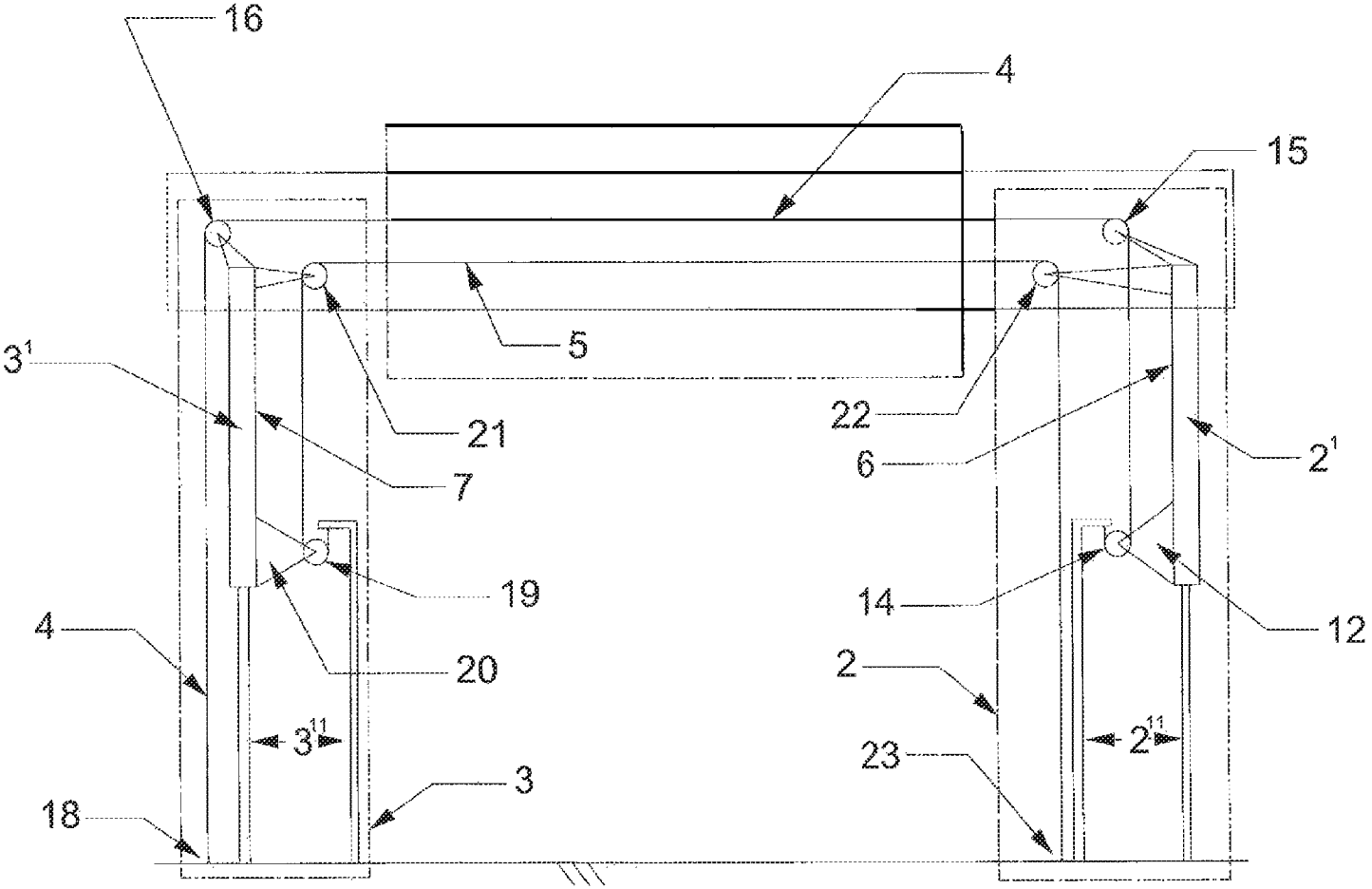
FIG. 1B provides a schematic representation of the frame according to FIG. 1A, according to an embodiment of the present invention.

FIG. 1B provides a schematic representation of the frame 1 shown in FIG. 1A. The frame 1 preferably comprises spaced apart legs 2, 3 for supporting the desk or tabletop. The legs 2, 3 each have upper portions 2', 3' and lower portions 2", 3". The upper portions 2', 3' and the lower portions 2", 3" are preferably extendable with respect to each other, and a dual cable linkage 4, 5 is provided at least comprising two separate cables 4 and 5.

Figure 6:
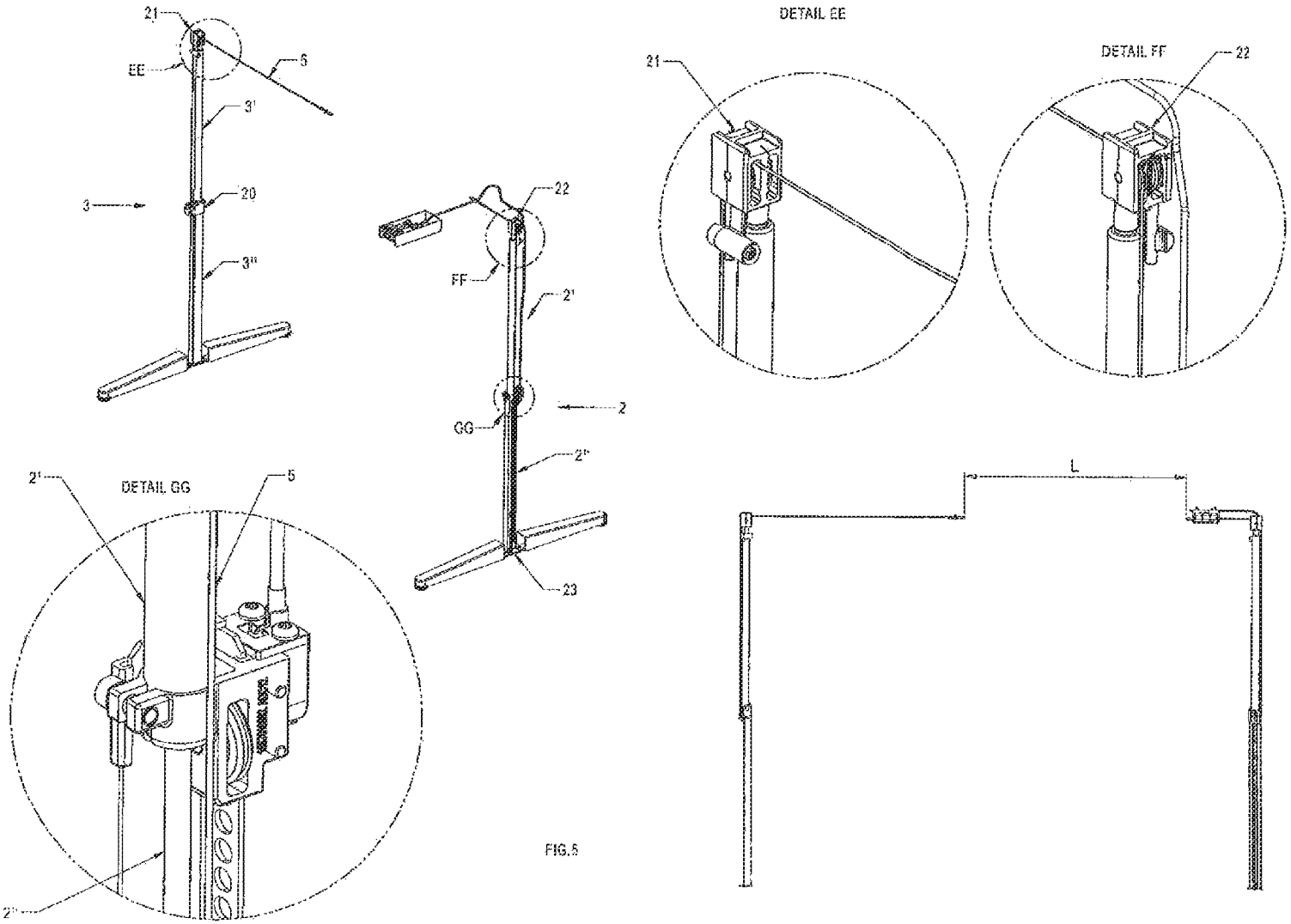
Figure 6:
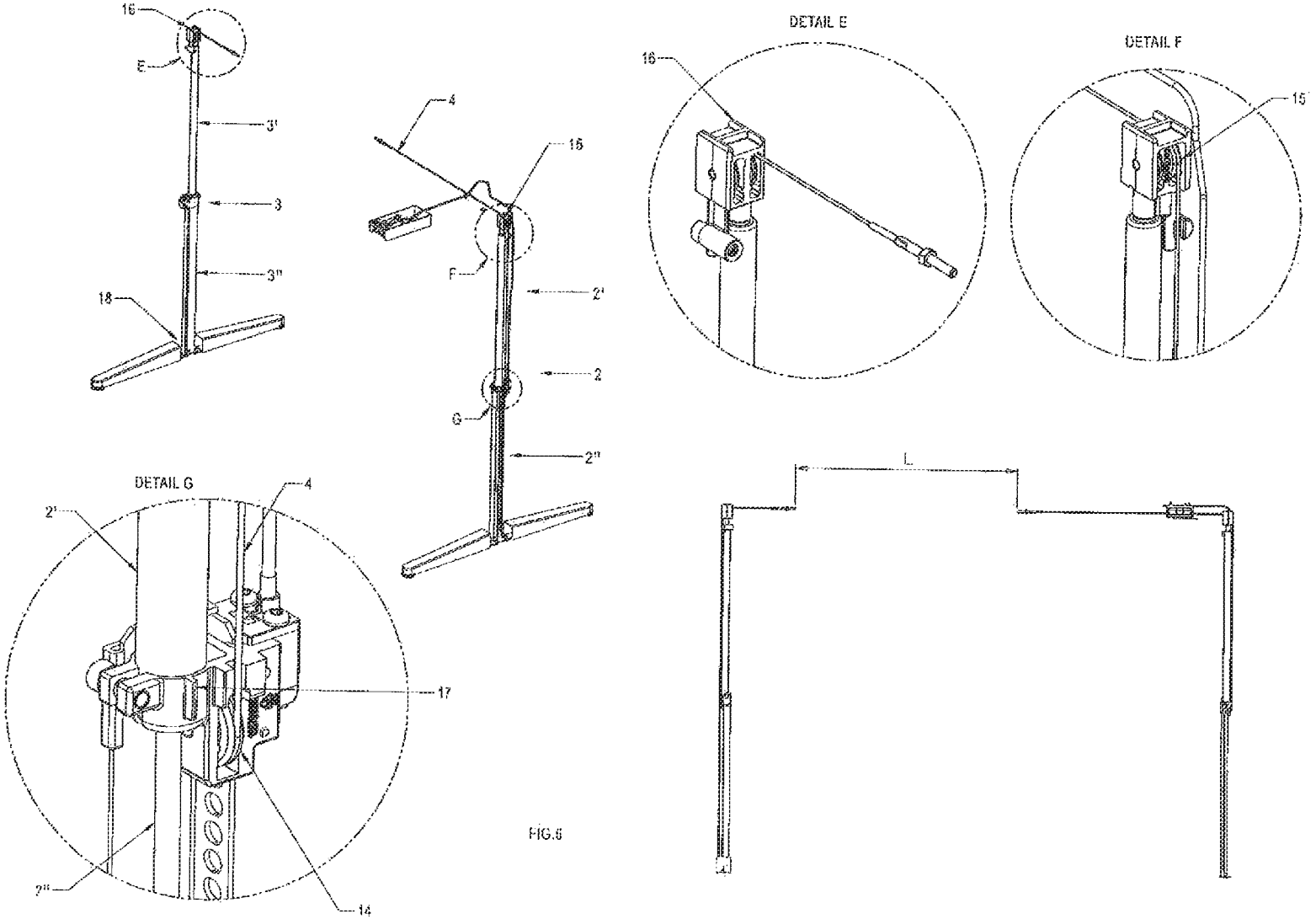
Figure 8:
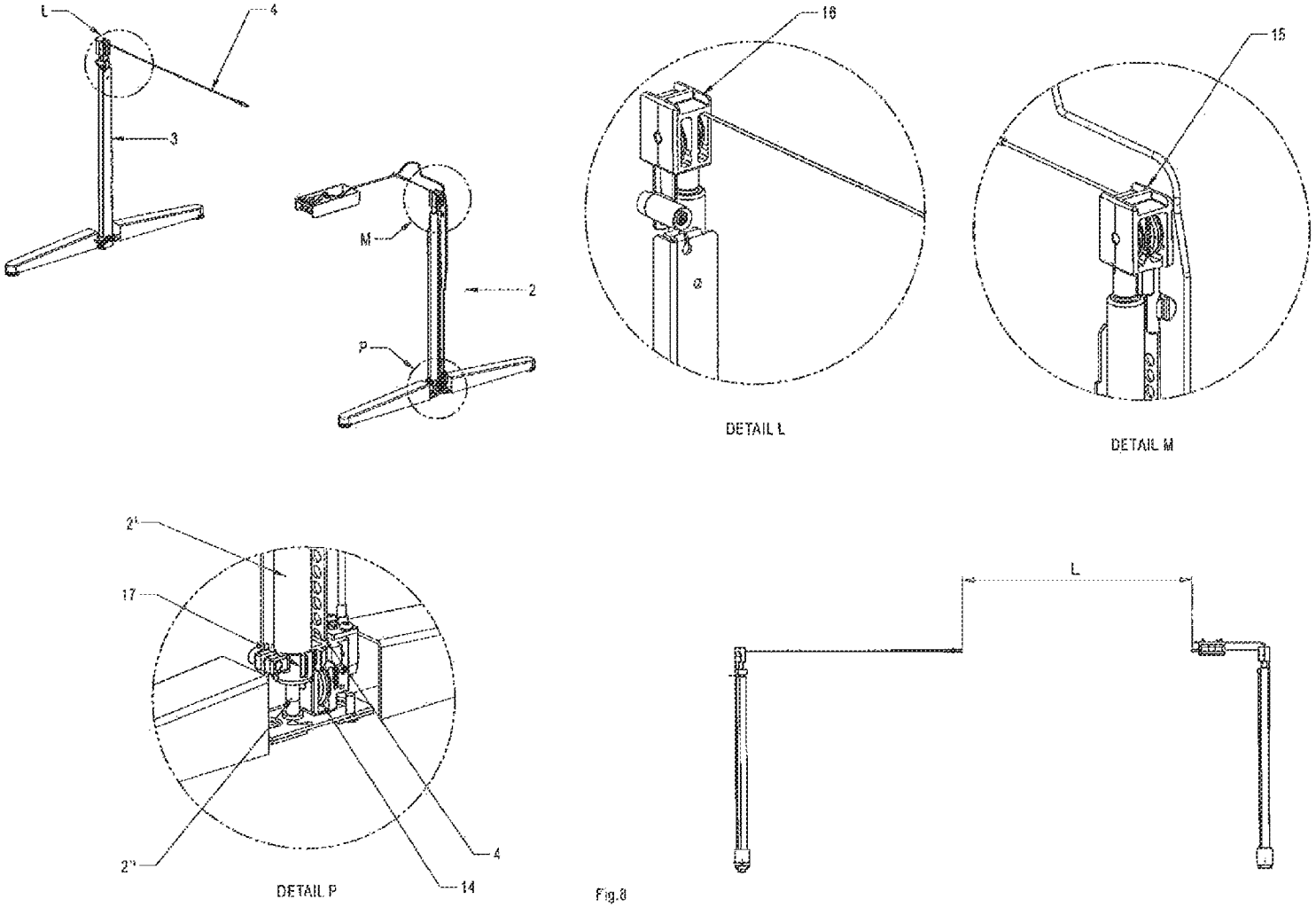
Figure 9:
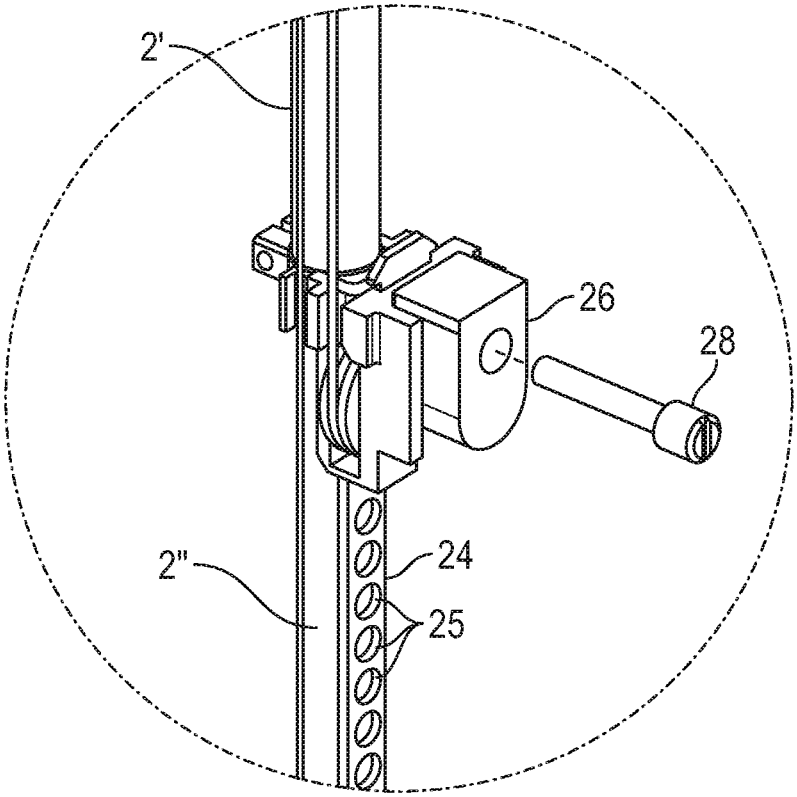
FIG. 9 shows a perspective view of an arresting system of the desk or tabletop according to an embodiment of the present invention.

With reference to FIG. 1B and FIGS. 6 and 8 it is shown that the first cable 4 is preferably guided via first guide means 14 connected with a lower end 17 of the movable upper portion 2' of the first leg 2 via second guide means 15, 16 to a lower end 18 of the lower stationary portion 3" of the second leg 3. FIG. 6 shows the relative position of the respective parts of the legs at a highest position of the desk or tabletop, and FIG. 8 shows the relative position of the respective parts of the legs at a lowest position of the desk or tabletop. For clarity only the first cable 4 is shown, and the second cable 5 is not depicted in FIGS. 6 and 8.

Figure 7:
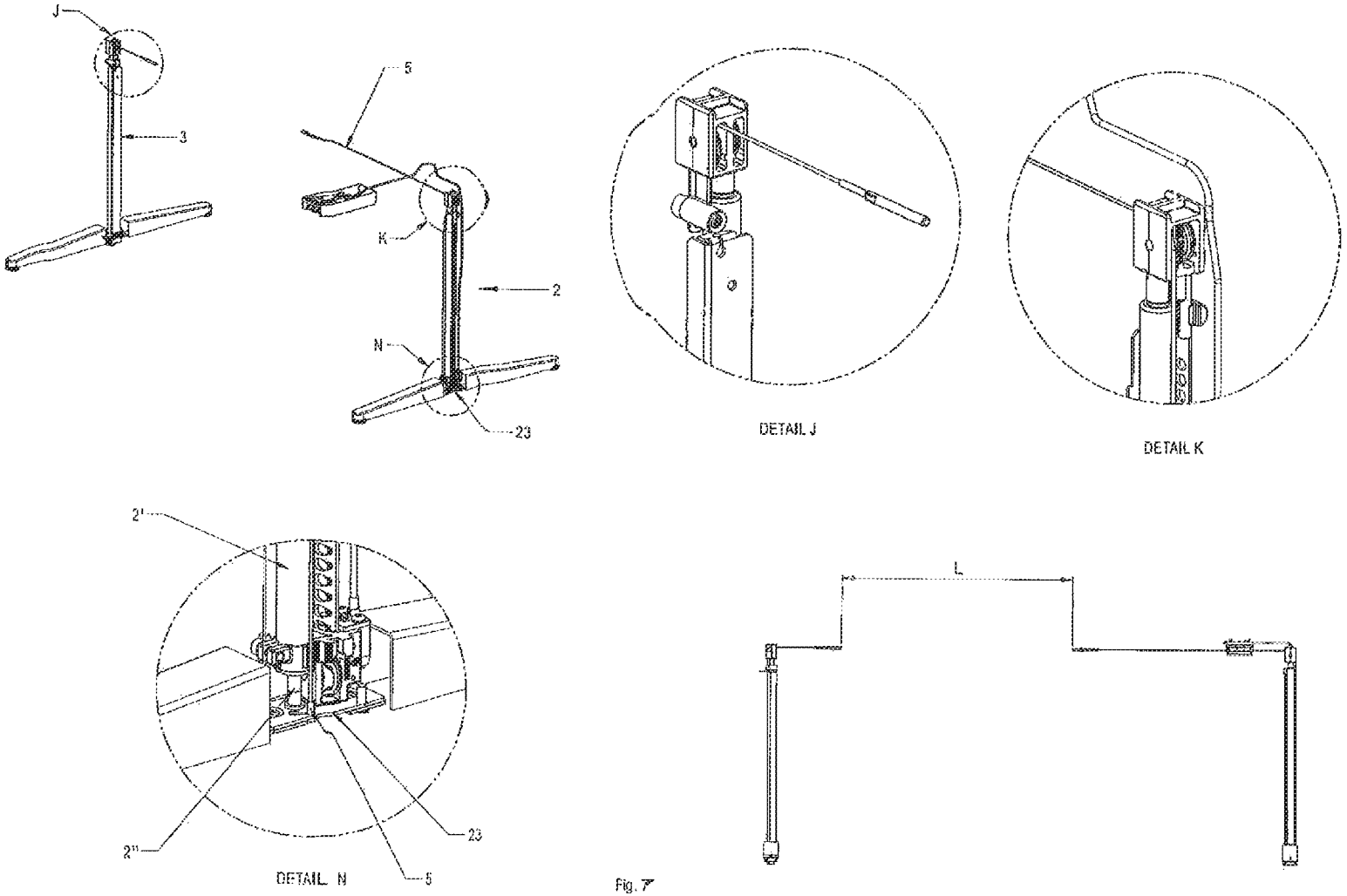
FIGS. 7 and 8 each show separately another single cable that connects different parts of the left and right leg of the desk or table, when the tabletop is at a low position, according to an embodiment of the present invention.

With reference to FIG. 1B and FIGS. 5 and 7 it is shown that a second cable b is preferably guided via third guide means 19 connected with a lower end 20 of the movable upper portion 3' of the second leg 3 via fourth guide means 21, 22 to a lower end 23 of the lower stationary portion 2" of the first leg 2. FIG. 5 shows the relative position of the respective parts of the legs at a highest position of the desk or tabletop, and FIG. 7 shows the relative position of the respective parts of the legs at a lowest position of the desk or tabletop. For clarity only the second cable 5 is shown, and the first cable 4 is not depicted in FIGS. 5 and 7.

This construction as discussed above with reference to FIGS. 1A/B and 5-8 secures that raising and lowering of the upper 2', 3' and lower portions 2", 3" of the respective legs 2, 3 is always executed in concert, i.e. both upper 2', 3' portions always move in sync with each other.

Figure 2:
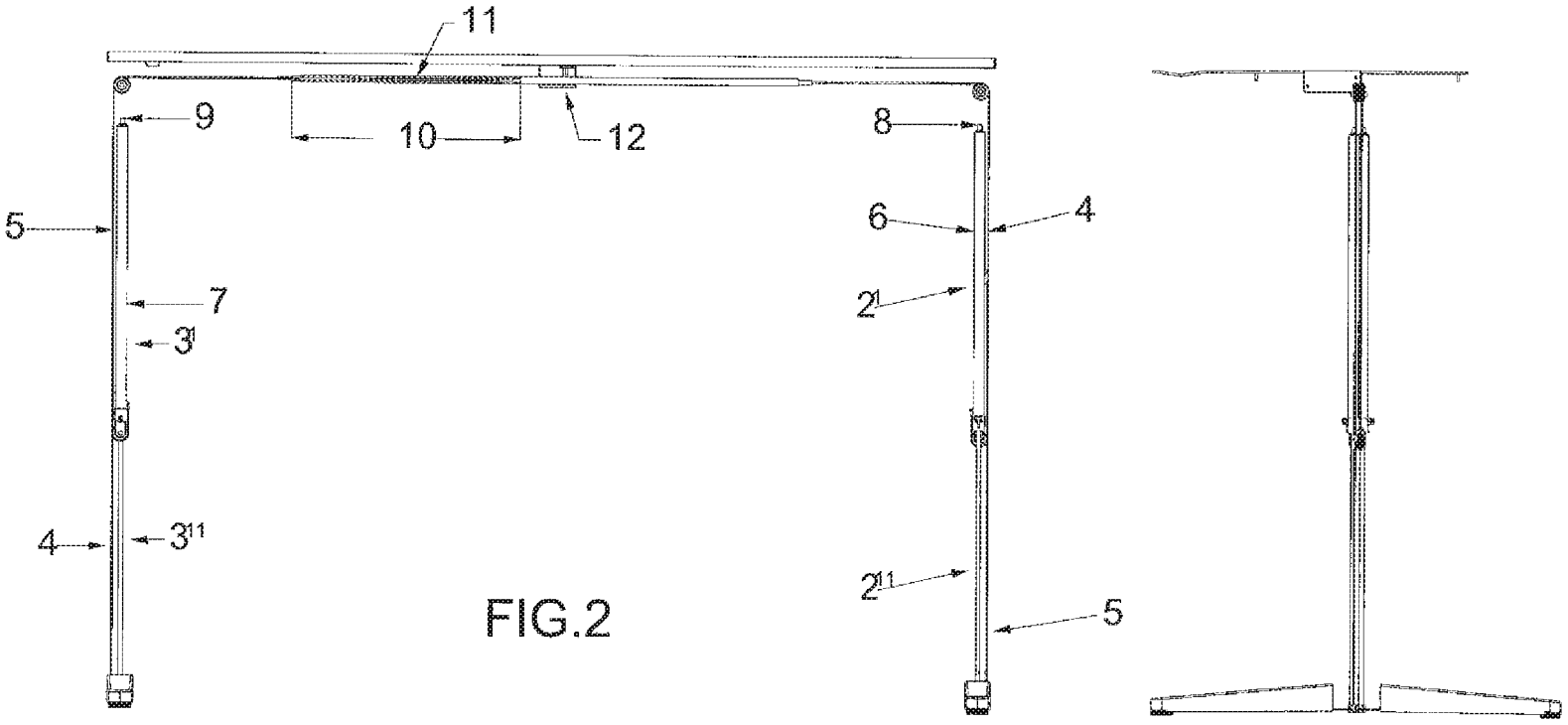
FIG. 2 shows a side view of the frame of FIG. 1, wherein for clarity certain parts are not shown, according to an embodiment of the present invention.

Preferably, the upper 2', 3' and lower portions 2", 3" of the legs 2, 3 are embodied as gas springs 6, 7. See also FIGS. 2 and 3, wherein a further preferable feature according to the invention is depicted, notably that one or both of the gas springs 6, 7 is provided with a valve 8, 9 to regulate the pressure in the gas springs 6, 7. This is one of the primary innovations of the embodiments of the present invention described in this application.

Figure 3:
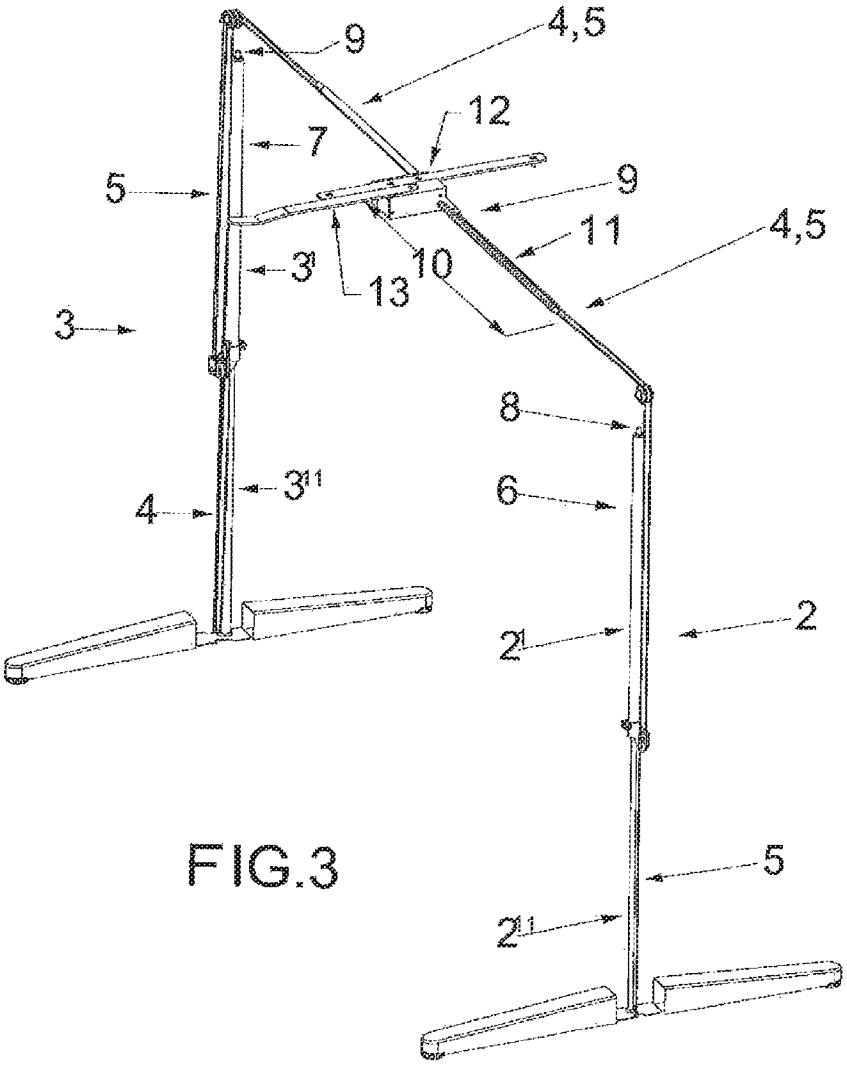
FIG. 3 shows a perspective view of the frame shown in FIG. 2 according to an embodiment of the present invention.

With reference to both FIG. 1 and FIG. 3 another aspect of an embodiment of the present invention is shown, wherein the cable linkage 4, 5 is preferably provided with a horizontal part 9 extending between the spaced apart legs 2, 3, wherein said horizontal part 9 comprises a section 10 with a corrugated surface or screw thread 11, which section 10 cooperates with an arresting block 12 which is manipulable with a handle 13. The arresting block 12 is capable to fix said section 10 of the horizontal part 9 in a selected position so as to fix the height of the desk or tabletop.

Figure 4A:
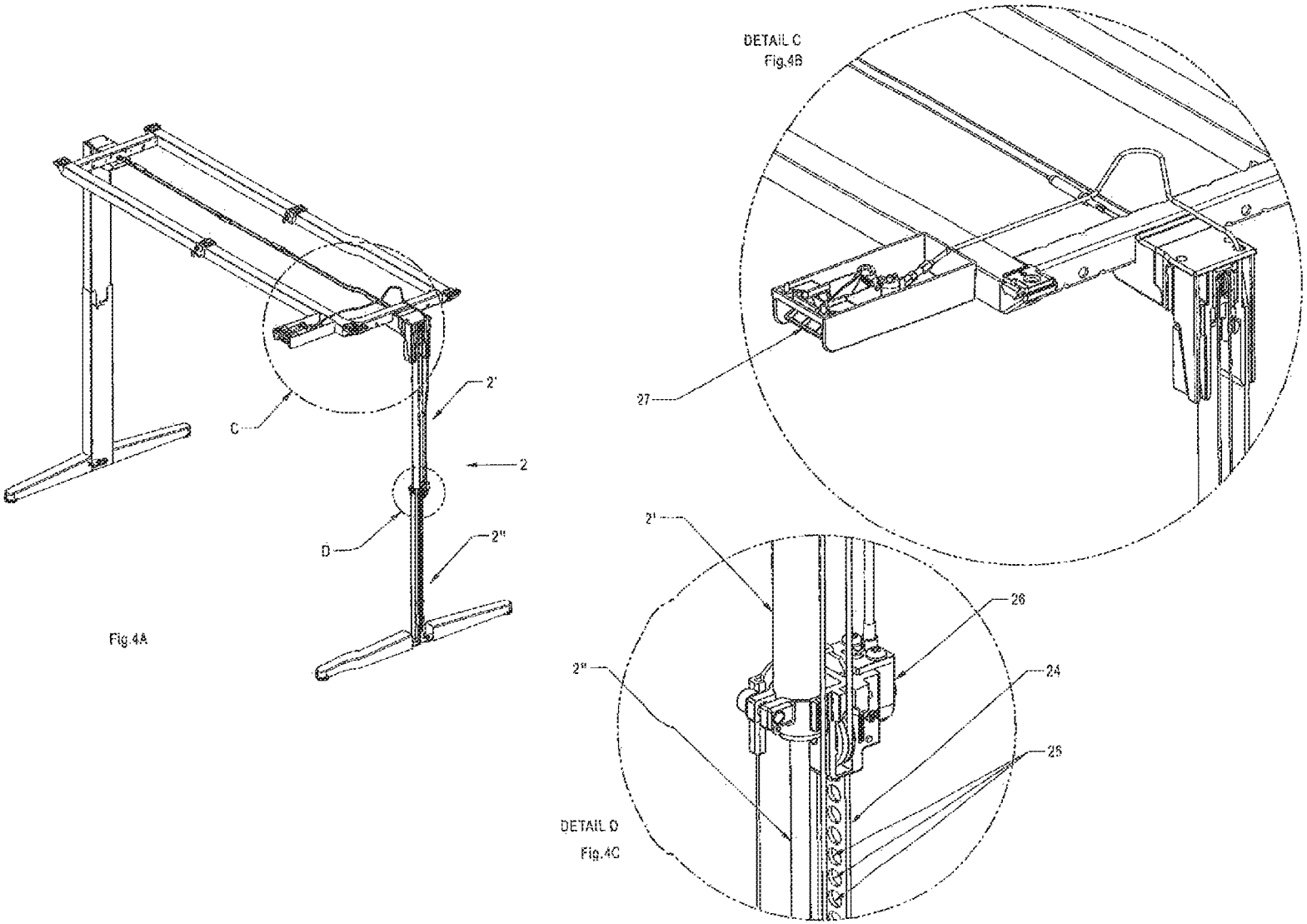
FIG. 4A shows in a perspective view a frame of a second embodiment of a desk or table according to an embodiment of the present invention.

Finally FIG. 4A shows in a perspective view a frame of a second embodiment of a desk or table according to the invention; wherein FIGS. 4B-4C show detail aspects of a preferred arresting system of the desk or table top of the invention, notably that leg 2 is provided with a rail 24 with slots 25, wherein the slots 25 are equipped to receive an arresting pin 28 (housed in housing 26 and therefore not visible) to selectively block movement of the movable upper portion 2' with respect to the lower portion 2" of said leg 2. FIG. 4B shows the control device 27 at a side of the frame with which control device 27 the said pin 28 can be moved into or out a particular slot 25 of the rail 24. The arresting pin 28 is provided at a stationary position of the lower portion 2" of the leg 2.

Although the invention has been discussed in the foregoing with reference to an exemplary embodiment of the frame of a height adjustable desk or table according to the invention, the invention is not restricted to this particular embodiment which can be varied in many ways without departing from the invention. The discussed exemplary embodiment shall therefore not be used to construe the appended claims strictly in accordance therewith. On the contrary the embodiment is merely intended to explain the wording of the appended claims without intent to limit the claims to this exemplary embodiment. The scope of protection of the invention shall therefore be construed in accordance with the appended claims only, wherein a possible ambiguity in the wording of the claims shall be resolved using this exemplary embodiment. Note that in the specification and claims, "about" or "approximately" means within twenty percent (20%) of the numerical amount cited.

NOMENCLATURE

1: frame

2: leg; 2': movable upper portion; 2": stationary lower portion

3: leg; 3': movable upper portion; 3": stationary lower portion

4: first cable

5: second cable
6: gas spring
7: gas spring
8: valve
9: horizontal part
10: horizontal section
11: screw thread
12: arresting block
13: handle
14: first guide means
15: second guide means
16: second guide means
17: lower end of upper portion first leg
18: lower end of lower portion second leg
19: third guide means
20: lower end of upper portion second leg
21: fourth guide means
22: fourth guide means
23: lower end of lower portion first leg
24: rail
25: slots
26: housing
27: control device

The invention claimed is:

1. A height adjustable desk or table comprising a desk or table top, and a frame with spaced apart legs for supporting the desk or table top, wherein each of the legs comprises a movable upper portion and a lower stationary portion, and wherein a first cable is guided via first guide means connected with a lower end of the movable upper portion of the first leg via second guide means to a lower end of the lower stationary portion of the second leg, and a second cable is guided via third guide means connected with a lower end of the movable upper portion of the second leg via fourth guide means to a lower end of the lower stationary portion of the first leg, wherein each of the legs comprises a gas spring, wherein for each gas spring the upper portion of the gas spring is arranged to be the up-and-down movable portion of the leg and the lower portion of each gas spring is arranged to be the lower stationary portion of the leg, wherein at least one of the legs is provided with a rail with slots, wherein the slots are equipped to receive an arresting pin to selectively block movement of the movable upper portion with respect to the lower portion of such leg.

2. The height adjustable desk or table according to claim 1, wherein each of the gas springs is provided with a valve to regulate the pressure in the gas springs.

3. The height adjustable desk or table according to claim 1, wherein the cables are provided with a horizontal part extending between the spaced apart legs, wherein the horizontal part comprises a section comprising a corrugated surface or screw thread, which section cooperates with an arresting block which is manipulable with a handle and which arresting block is capable to fix the section in a selected position so as to fix the height of the desk or table top.

4. The height adjustable desk or table according to claim 1, wherein the arresting pin is provided at a stationary position of the lower portion of the leg, and has actuating means that are provided at a side of the desk or tabletop.

* * * * *